US005100015A

United States Patent [19]

Vanderstuyf

[11] Patent Number: 5,100,015

[45] Date of Patent: Mar. 31, 1992

[54] LATCH UNIT FOR CONTAINER AND MATING LID

[75] Inventor: Al Vanderstuyf, Novi, Mich.

[73] Assignee: Electro-Wire Products, Inc., Dearborn, Mich.

[21] Appl. No.: 726,369

[22] Filed: Jul. 5, 1991

[51] Int. Cl.[5] ..... B65D 45/16

[52] U.S. Cl. ..... 220/326; 220/324; 292/87; 292/DIG. 38

[58] Field of Search ..... 220/324, 326; 215/216; 292/87, DIG. 33

[56] References Cited

U.S. PATENT DOCUMENTS

| | | | |
|---|---|---|---|
| 4,212,415 | 7/1980 | Neely | 222/231 |
| 4,589,567 | 5/1986 | Pircher | 220/326 |
| 4,746,008 | 5/1988 | Heverly et al. | 206/1.5 |
| 4,880,116 | 11/1989 | Kos | 206/454 |
| 4,892,208 | 1/1990 | Sledge | 215/216 |
| 4,901,882 | 2/1990 | Goncalves | 220/324 |

*Primary Examiner*—Stephen Marcus
*Assistant Examiner*—Nova Stucker
*Attorney, Agent, or Firm*—Krass & Young

[57] ABSTRACT

A latch unit for releasably latching a lid to a mating container. The latch unit comprises a horizontally disposed resilient beam which is spaced from the rim of either the lid or the container and includes a resilient finger plate which extends toward the bottom of the lid or container to terminate in a free end. The finger plate has a detent disposed at its other end with a horizontal abutment surface. A locking cage is disposed on the side wall of the other of the lid or container and includes a horizontally disposed stop for engagement with the abutment surface when the latch unit is latched. The latch unit may be unlatched by flexing the finger plate to release the detent from the stop.

19 Claims, 2 Drawing Sheets

LATCH UNIT FOR CONTAINER AND MATING LID

BACKGROUND OF THE INVENTION

1. Field of the Invention

This invention relates generally to the field of latches, and, more particularly, to such a latch for releasably securing a lid to a mating container.

2. Description of the Relevant Prior Art

Latches, of course, are scarcely a recent technological innovation. With the development of modern, resilient, polymeric materials, a variety of new techniques have been developed for releasably latching a lid to a mating container. These modern latches take advantage of the resilience of the polymeric material; the resilient tongue of such a latch is pivotally movable from a first position, where it engages the catch portion of the latch, to a second position wherein the tongue is disengaged from the catch. Due to the resiliency of the material, the tongue of such a latch can be molded in one piece with, for example, the lid of the container, the point at which they meet serving as a sort of self-hinge to permit the pivotal movement necessary to latch and unlatch the container.

The prior art is replete with latch designs using the self-hinge principal described above. For example, see U.S. Pat. Nos. 4,501,378; U.S. Pat. No. 4,718,571, and U.S. Pat. No. 4,746,008. The latch disclosed in the '008 patent is a good example of a simple prior art latch utilizing this principal. The '008 patent discloses a latch including a wedge-shaped tongue 20 with a stepped shoulder portion, said tongue being insertable into an outwardly projecting slot, the abutment of the shoulder with the bottom surface of the slot wall serving to prevent disengagement of the tongue from the slot. By pressing the tongue inwardly, the wedge will slip back through the slot so that the cover may be disengaged from the container.

Latching arrangements of this sort have met with broad, commercial success, but do suffer from certain inherent disadvantages. It is quite easy to deflect the tongue too far, thus overstressing the self-hinge, and causing the tongue to break off. Furthermore, the tongues of such prior art latches frequently have a long travel to engage or disengage. Also, they are not self-aligning, a distinct disadvantage in assembly operations. Furthermore, in cases where pairs of such latches are used at opposite ends of the container, it is very common for the user to accidently break off the tongue of one latch while attempting to operate its opposite member.

SUMMARY OF THE INVENTION

The present invention has been designed to overcome the disadvantages noted in the prior art. In its broadest aspects, it is a latching unit suitable for releasably securing a container and its mating lid. The container is of the type having a top, bottom, side wall and a rim defining an opening, the rim being disposed on the side wall proximate the top of the container. Its mating lid is adapted to cover the opening and has a top, bottom, side wall and a rim disposed on the side wall proximate the top of the lid.

The latch unit of the present invention includes a resilient beam which is disposed on either the rim of the lid or the rim of the container, and spaced outwardly from the side wall thereof. A resilient finger plate is disposed on the beam and extends vertically toward the bottom (of either the lid or the container) for a distance to terminate in a free end. The resilient finger plate is normally biased to lie substantially parallel to the side wall of the container or lid, as the case may be. A detent is disposed on a surface of said finger plate proximate the end thereof opposite the free end. It has an abutment surface formed thereon which faces the bottom of the container or the lid.

A locking cage is disposed on the side wall of the other of the container or the lid. In other words, if the resilient beam and finger plate are disposed on the lid, then the locking cage is disposed on the side wall of the container. Conversely, if the resilient beam and finger plate are disposed on the rim of the container, then the locking cage will be disposed on the side wall of the lid. In either case, the locking cage extends outwardly from the side wall of the container or the lid. The cage terminates in a horizontally disposed stop which is matingly engagable with the abutment surface, when the lid is seated on the container. The lid may then be disengaged from the container by pressing on the free end of the finger plate, thereby causing it to deflect such that the abutment surface disengages from the stop, thereby permitting free passage of the finger plate and beam from the locking cage.

The various elements of the locking unit of the present invention are designed such that they may be molded integrally with the container and lid. Moreover, because of the present invention's unique design, the container and lid with the latching unit components molded thereon may be produced by straight pull tooling on the mold, a technique which represents a great savings in time and expense.

In order to prevent accidental deflection of the finger plate, which might occur if objects like wire were to be entangled therewith, a pair of vertically oriented guard plates may be provided the latch unit of the present invention. The guard plates extend from the side wall of either the container or the lid outwardly and are disposed outboard on each side of the finger plate. The finger plate may be provided with finger engaging means in a form of a pair of spaced apart blips disposed on the free end of the finger plate. The finger engaging means are designed to prevent slippage of the finger or thumb as it presses on the finger plate.

In one embodiment of the latch unit of the present invention, the locking cage comprises a pair of opposed, vertically extending side rails and a cross piece connecting them proximate the tops thereof. The stop which engages the abutment surface is formed by the lower face of the cross piece. The pair of side walls may each further comprise a cut-out portion adapted to accommodate the resilient beam when the latch unit is engaged. Furthermore, the side rails may also comprise a pair of alignment plates disposed on the inner side of each of said side rails. The alignment plates are oriented parallel to the side wall and are spaced for a distance from each other to accommodate the detent portion of the finger plate. Since the alignment rails are spaced this distance apart, they serve to prevent accidental lateral motion between the lid and the container when the latch unit is engaged.

In another preferred embodiment of the present invention, alignment tabs are disposed on the resilient beam and extend outwardly therefrom. They are spaced a distance apart sufficient to accommodate the side rails of the latching cage when the latch unit is engaged. The alignment tabs also serve to prevent undesirable lateral displacement of the lid relative to the container.

In one preferred embodiment of the present invention, the resilient beam is attached to the rim of either the container or the lid at each end thereof. Due to its resiliency, the beam will flex inward and partially rotate when the free end of the finger plate is pressed inward, thus freeing the detent from the locking cage. The amount of deflection may be controlled by providing the resilient beam with torsion adjustment means in the form of a pair of cross members connecting said beam with said rim at locations thereon outboard of the finger plate. The exact positioning of the cross pieces will determine the amount the detent will be displaced for a given force exerted on the free end of the finger plate. The closer the cross pieces are disposed to the finger plate, the less the detent will be displaced for a given amount of force; in other words, greater force will have to be exerted on the finger plate to cause it to be displaced inwardly. Conversely, the farther the cross pieces are disposed from the finger plate, the more the finger plate will be displaced for a given amount of force exerted on the free end thereof.

In another preferred embodiment, the latching unit of the present invention further comprises means for preventing the finger plate from deflecting inwardly for too great a distance. This embodiment is designed to overcome the prior art problem of snapping off the tongue of the latch when it is pressed too hard. In one particular embodiment of the means for preventing extreme deflection of the finger plate, the means comprise a pair of struts which taper outwardly from the bottom of the lid or container to the rim thereof. These struts are disposed at a location on the side wall of the lid or container such that deflection of the finger plate inwardly for a certain distance will cause it to come to rest against the edges of the strut, thus preventing further travel.

BRIEF DESCRIPTION OF THE DRAWINGS

The following detailed description may best be understood with reference to the following drawing, in which.

DETAILED DESCRIPTION OF THE PREFERRED EMBODIMENTS

Figure 1:
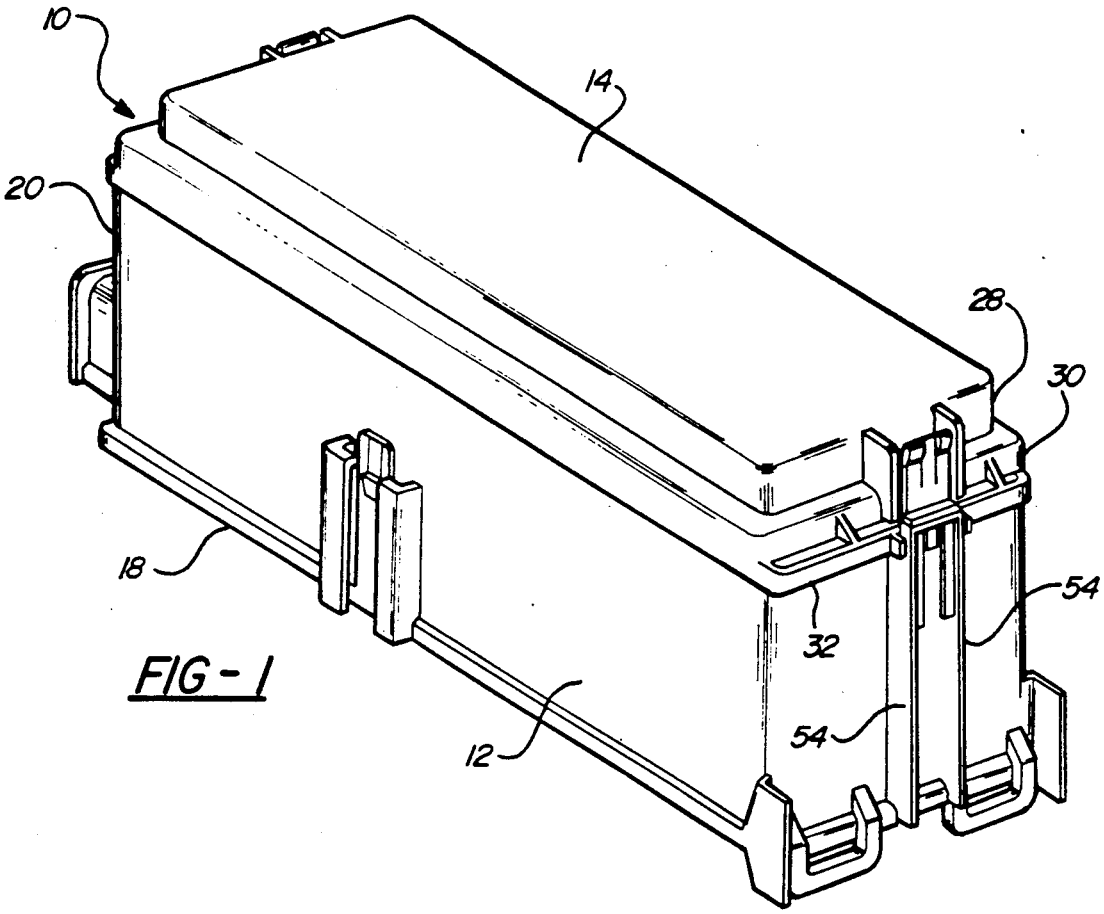
FIG. 1 is a perspective view of a container and mating cover equipped with a latch unit constructed in accordance with the teachings of the present invention.

Throughout the following detailed description, like reference numerals are used to refer to the same element of the drawings shown in multiple figures thereof. Referring now to the drawings, and in particular to FIG. 1, there is shown a latching unit 10 for use on a container 12 having a mating lid 14. The container 12 comprises a top 16, a bottom 18, and a side wall 20 with a rim 22 (FIG. 3) disposed thereon. The lid 14 also comprises a top 24, a bottom 26, a side wall 28, and a rim 30 disposed along the top 28 of the lid 14. Lid rim 30 is configured and sized appropriately so that it covers and encloses the rim 22 of the container 12.

Figure 4:
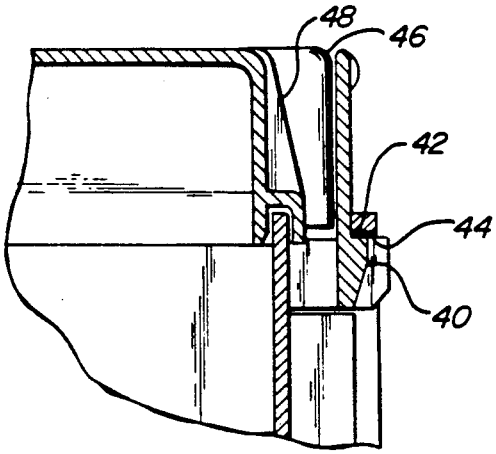
FIG. 4 is a top view of the latch unit depicted in FIG. 1.
Figure 5:
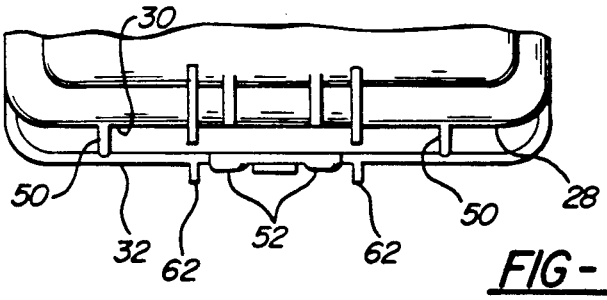
FIG. 5 is a bottom view of the latch unit shown in FIG. 1.

Disposed at an end of lid 14 is a resilient beam 32. As can best be seen in FIGS. 4 and 5, resilient beam 32 is spaced apart from lid side wall 28 and is attached thereto at its ends 64.

Figure 2:
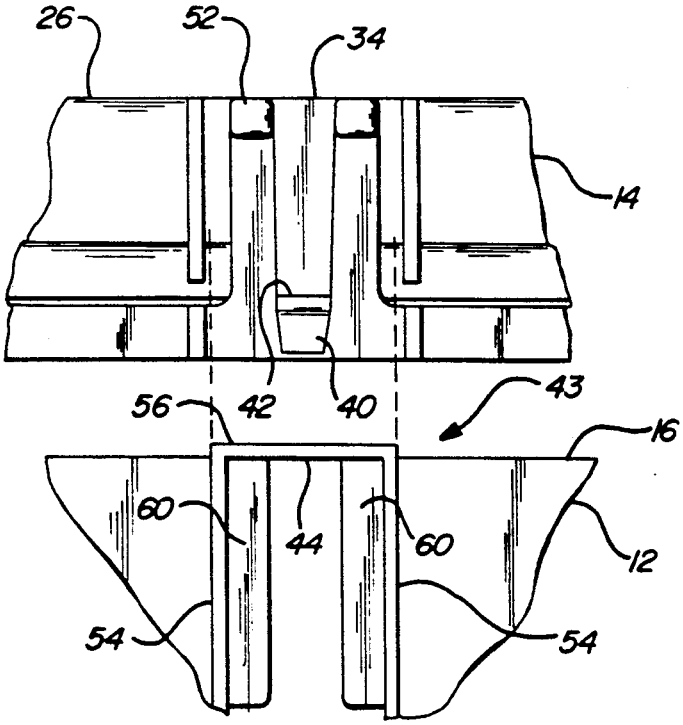
FIG. 2 is a front view of the latch unit of FIG. 1 showing the lid disengaged from the container.
Figure 3:
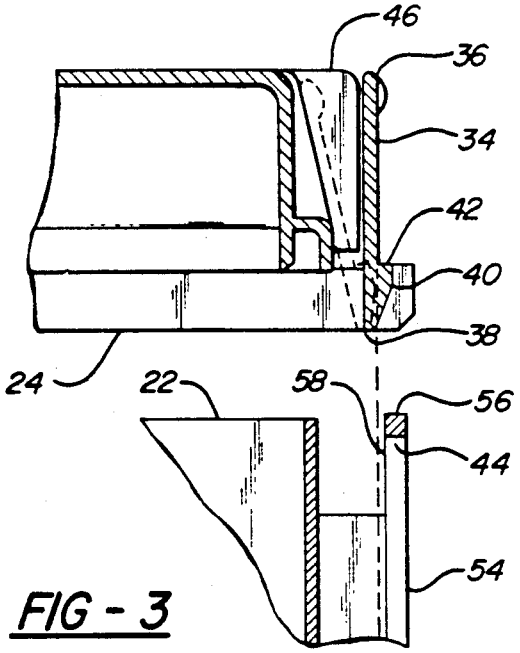
FIG. 3 is a cross section of the view shown in FIG. 2 with the finger plate displaced inwardly shown in phantom.

Referring now to FIGS. 2 and 3, a finger plate 34 is disposed on resilient beam 32 and extends for a distance toward the bottom 26 of lid 14 to terminate in a free end 36. A pair of blips 52 are disposed on free end 34 so that the finger of a user who is pressing free end 36 of finger plate 34 will not easily slip. At the other end 38 of finger plate 34 is disposed a detent 40 having an abutment surface 42 which faces toward lid bottom 26.

Figure 6:
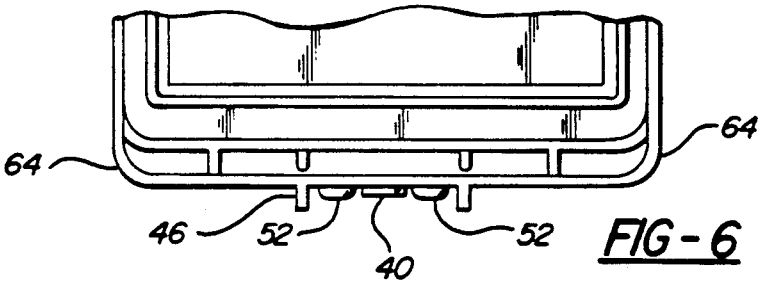
FIG. 6 is a cross section similar to FIG. 3 with the elements of the latch unit engaged.

Disposed on the side wall 20 of container 12 at a location thereon corresponding to the location of finger plate 34 on lid 14 is a locking cage 43. Locking cage 43, in the embodiment depicted in the drawings, is comprised of a pair of vertically extending, opposed side rails 54 and a connecting cross piece 56 lying proximate container rim 22. The bottom surface of cross piece 56 is formed as a stop means for mating engagement with abutment surface 42 when the finger plate 34 of locking unit 10 is engaged with locking cage 43, as can be seen most clearly in FIG. 6, which is a cross section depicting the lock unit in its engaged mode. When in the engaged position shown in FIG. 6, stop 44 prevents abutment surface 42 from moving out of the engaged position. In order for locking cage 43 to accommodate resilient beam 32 and finger plate 34 when the container 12 is engaged with the lid 14, each of the side rails 54 has a cut-out portion 58 (best seen in FIG. 3).

The locking cage 43 may further comprise a pair of alignment plates 60 which are disposed one on each of the side rails and extend inwardly to define a space therebetween. The space is sized to accommodate the width of the detent 40 when the finger plate 34 is engaged with the locking cage 43. By providing alignment plates 60 on locking cage 43, undesirable side-to-side motion between container 12 and lid 14 is effectively prevented. The alignment bars 60 further serve to align finger plate 34 with locking cage 43.

Further alignment means are provided in the form of alignment tabs 62 which are disposed on resilient beam 32 proximate each side of finger plate 34. The alignment bars 62 are spaced apart from each other such that, when finger plate 34 is engaged with locking cage 43, side rails 54 will lie just inside the alignment tab 62. Again, alignment tabs 62 prevent undesirable lateral motion between container 12 and lid 14 and help align the two parts of the latch unit.

The embodiment of the present invention shown in the drawings also has additional features which serve to protect finger plate 34 from superfluous or too extreme motion. For example, a pair of guard plates 46 are disposed on side wall 28 of lid 14 on either side of finger plate 34. The purpose of the guard plates 46 is to prevent superfluous and undesirable flexing of finger plate 34. For example, the container 12 and lid 14 may be used in environments containing objects such as moving bars, wires, hooks, et cetera, which may accidentally catch upon finger plate 34 and cause the device 10 to unlatch. Obviously, this could be a highly undesirable outcome. Guard plates 46 effectively serve to prevent such snagging of finger plate 34.

The problem of snapping off the tongue of a plastic latch due to undue pressure, causing it to fracture along the self-hinge line, has been discussed in the Background section of the specification. In the embodiment shown in the Figures, the finger plate 34 is flexed inwardly toward side wall 28 to unlatch the locking unit 10. While the presence of side wall 28 serves as a limit to how far the finger plate 34 can be flexed, it may be desirable to provide an additional safeguard in the form of a pair of anti-deflection struts 48, which are most clearly seen in FIGS. 4 and 6. The anti-deflection struts 48 are disposed on rim 30 and side wall 28 and taper inwardly from the top 24 of the lid to the bottom 26 thereof, thereby presenting an inclined surface, as may be seen in FIG. 6. The anti-deflection struts 48 are disposed on side wall 28 and rim 30 at locations thereon such that, when finger plate 34 is deflected inwardly for a certain distance, finger plate 34 will contact the anti-deflection struts 48 and be prevented from further, and undesirable, deflection inward.

In the embodiment depicted in the drawings, a pair of latching devices 10 are provided, one on each end of the container 12 and lid 14. Such an arrangement is desirable when it is necessary that the lid be completely removable from the container. By changing the spacing of one set of alignment tabs 62 and the width of one finger plate 34, the cover can be designed so it cannot accidentally be put on backwards (rotated 180°). It has been found that in actual use, one need only press the finger plate of one of the opposed latch units to unlatch the lid from the container. After one latch unit has been released in this way, the cover can be rotated a small amount and the other latch unit will simply rotate apart.

Obviously, the pair of latches 10 could also be disposed on the sides, instead of the ends, of container 12 and lid 14 and serve the same purpose. However, for some uses, sufficient access may be provided the container by simply opening the lid at the edge, or side, and leaving the opposed end or side hinged to the container. In such a case, only one latch unit 10 may be sufficient to secure the lid to the container.

It should be noted that the embodiment depicted in FIG. 1 is designed as the power distribution box for a vehicle. The latch unit of the present invention finds particular utility in a usage such as this where the container and lid are in a crowded, mechanically complex environment. Due to the guard plates and alignment devices described above, the latch units of power distribution box is not likely to be accidentally snagged or caught by other under-the-hood components. Furthermore, if both finger plates are depressed to remove the cover, the cover need only be raised a very small distance above the container and then slid off. This operation is particularly suited to crowded, low height environments, such as under the hood. Obviously, however, the latching units of the present invention are not confined to this usage and are useful for any lid/container combination.

Another advantage of the locking unit of the present invention over prior art latches described in the background of the specification is that, when used in pairs as described above, one latch unit may be disengaged without snapping off the tongue (finger plate) of the opposed latch unit, a known problem in the prior art.

Because of the unique positioning of the finger tongue on the resilient beam, the amount of force which is required to deflect finger plate 34 inwardly and unlatch the locking unit may be readily adjusted. Obviously, the amount of force which may be applied will depend on such things as the characteristics of the material, the thickness of the finger plate, the thickness of the resilient beam, et cetera. However, these factors may be kept constant and the amount of force needed may be readily and easily adjusted by providing adjustment means in the form of torsion tuning bars 50 which interconnect resilient beam 32 with lid side wall 28. Each torsion tuning bar 50 is located between an end 64 of resilient beam 32 and finger plate 34 Their exact location within these confines will determine how much pressure needs to be applied to deflect finger plate 34 inwardly. The closer the torsion tuning means 50 lie to finger plate 34, the more pressure will have to be applied. Conversely, the closer they lie to the ends 64 of resilient beam 32, the less pressure will have to be applied.

Obviously, while the embodiment depicted in the drawings shows the finger plate disposed on the lid and the resilient cage disposed on the container, these positions could be reversed as the circumstances warrant. Furthermore, the finger plate 34 may be designed to have a somewhat different configuration than that depicted; for example, the detent could be disposed on its inner face, in which case, the finger plate would have to be deflected outwardly to release the latch mechanism. However, such modifications are deemed to be within the expertise of one skilled in the art by applying the teachings of the present invention. The scope of the present invention is not intended to be limited by the embodiments and exemplifications described herein, but, rather, solely by the claims appended hereto.

I claim:

1. A container having a top, bottom, a side wall and a rim defining an opening disposed on said side wall proximate the top of the container, a mating lid for covering said opening and having a top, bottom, side wall, and a rim disposed on said side wall proximate the top of the lid, and at least one latch unit for releasably securing said lid to said container, wherein said latch unit comprises:

a resilient beam disposed on the rim of one of said lid and said container and spaced outwardly from said side wall thereof;

a resilient finger plate initially formed on said beam and extending vertically toward said bottom of said one of said lid and said container for a distance to terminate in a free end and being normally biased to lie substantially parallel to said side wall;

a detent disposed on a surface of said finger plate proximate an end thereof opposite said free end and having an abutment surface formed thereon facing said bottom of said one of said lid and said container; and a locking cage disposed on the sidewall of the other of said container and said lid and extending outwardly therefrom, said cage terminating in a horizontally disposed stop matingly engaged with said abutment surface when said lid is seated on said container, whereby finger pressure on the free end of said finger plate deflects it such that said abutment surface disengages from said stop so that said lid may be removed from said container.

2. The device of claim 1 further comprising a pair of vertically oriented guard plates extending from the side wall of one of said container and said lid and disposed outboard of and on each side of said finger plate to prevent accidental deflection of said finger plate.

3. The device of claim 1 further comprising torsion adjustment means including a pair of cross members connecting said beam with the rim of said one of said container and said lid at locations thereon outboard of said finger plate.

4. The device of claim 1 further comprising finger engaging means disposed on said free end of said finger plate and including a pair of spaced apart blips.

5. The device of claim 1 wherein the locking cage comprises a pair of opposed, vertically extending side rails and a cross piece connecting them proximate the tops thereof, wherein said stop is formed by the bottom face of said cross piece.

6. The device of claim 5 wherein the pair of side rails each further comprise a cutout portion to accommodate said beam when said lid is seated on said container.

7. The device of claim 1 further comprising means for preventing said finger plate from deflecting inwardly too far.

8. A container having a top, bottom, and a side wall defining an opening, a mating lid for covering said opening and having a top, bottom, side wall, and a rim disposed on said side wall proximate the top of the lid, and at least one latch unit for releasably securing said lid to said container, wherein said latch unit comprises:

a resilient beam disposed on the rim of said lid and spaced outwardly from said side wall thereof;

a resilient finger plate initially formed on said beam and extending vertically toward said bottom of said lid for a distance to terminate in a free end and being normally biased to lie substantially parallel to said side wall;

a detent disposed on an outer surface of said finger plate proximate an end thereof opposite said free end and having an abutment surface formed thereon facing said bottom of said lid; and a locking cage disposed on the sidewall of said container and extending outwardly therefrom, said cage terminating in a horizontally disposed stop matingly engagable with said abutment surface such that, when said lid is seated on said container, portions of said finger plate and beam are disposed inside of said locking cage, whereby finger pressure on the free end of said finger plate deflects it inwardly such that said abutment surface disengages from said stop so that said lid may be removed from said container.

9. The device of claim 8 further comprising a pair of vertically oriented guard plates extending from the side wall of said lid and disposed outboard on each side of said finger plate to prevent accidental deflection of said finger plate.

10. The device of claim 8 further comprising torsion adjustment means including a pair of cross members connecting said beam with said rim at locations thereon outboard of said finger plate.

11. The device of claim 8 wherein the locking cage comprises a pair of opposed, vertically extending side rails and a cross piece connecting them proximate the tops thereof, wherein said stop is formed by the bottom face of said cross piece.

12. The device of claim 11 wherein the pair of side rails each further comprise a cutout portion to accommodate said beam when said lid is seated on said container.

13. The device of claim 8 further comprising means for preventing said finger plate from deflecting inwardly too far.

14. A latch unit for releasably securing a lid on a mating container, said container being of the type having a top, bottom, a side wall and a rim disposed on said side wall proximate the top of the container, and said lid being of the type having a top, bottom, side wall, and a rim disposed on said side wall proximate the top of the lid, wherein said latch unit comprises:

a resilient beam disposed on the rim of one of said lid and said container and spaced outwardly from said side wall thereof;

a resilient finger plate initially formed on said beam and extending vertically toward said bottom of said one of said lid and said container for a distance to terminate in a free end and being normally biased to lie substantially parallel to said side wall;

a detent disposed on an outer surface of said finger plate proximate an end thereof opposite said free end and having an abutment surface formed thereon facing said bottom of said one of said lid and said container; and a locking cage disposed on the sidewall of the other of said container and said lid and extending outwardly therefrom, said cage terminating in a horizontally disposed stop matingly engagable with said abutment surface such that, when said lid is seated on said container, portions of said finger plate and beam are disposed inside of said locking cage, whereby finger pressure on the free end of said finger plate deflects it inwardly such that said abutment surface disengages from said stop so that said lid may be removed from said container.

15. The latch unit of claim 14 further comprising a pair of vertically oriented guard plates extending from the side wall of one of said container and said lid and disposed outboard on each side of said finger plate to prevent accidental deflection of said finger plate.

16. The latch unit of claim 14 further comprising torsion adjustment means including a pair of cross members connecting said beam with the rim of said one of said container and said lid at locations thereon outboard of said finger plate.

17. The latch unit of claim 14 wherein the locking cage comprises a pair of opposed, vertically extending side rails and a cross piece connecting them proximate the tops thereof, wherein said stop is formed by the bottom face of said cross piece.

18. The latch unit of claim 17 wherein the pair of side rails each further comprise a cutout portion to accommodate said beam when said lid is seated on said container.

19. The latch unit of claim 1 further comprising means for preventing said finger plate from deflecting inwardly too far.

* * * * *

UNITED STATES PATENT AND TRADEMARK OFFICE

CERTIFICATE OF CORRECTION

PATENT NO. : 5,100,015

DATED : March 31, 1992

INVENTOR(S) : Al Vanderstuyf

It is certified that error appears in the above-identified patent and that said Letters Patent is hereby corrected as shown below:

Column 6, line 45, Please delete "initially" and insert --unitarily--.

Column 7, line 29, Please delete "initially" and insert --unitarily--.

Column 8, line 18, Please delete "initially" and insert --unitarily--.

Signed and Sealed this

Thirty-first Day of August, 1993

*Attest:*

*Attesting Officer*

Bruce Lehman

BRUCE LEHMAN

*Commissioner of Patents and Trademarks*